US011794498B2

(12) United States Patent
Tokuyama et al.

(10) Patent No.: US 11,794,498 B2
(45) Date of Patent: Oct. 24, 2023

(54) PROCESSING APPARATUS

(71) Applicant: CANON KABUSHIKI KAISHA, Tokyo (JP)

(72) Inventors: Kaneto Tokuyama, Tokyo (JP); Yasuhito Tsubakimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 17/496,565

(22) Filed: Oct. 7, 2021

(65) Prior Publication Data

US 2022/0111671 A1 Apr. 14, 2022

(30) Foreign Application Priority Data

Oct. 14, 2020 (JP) ..... 2020-173280

(51) Int. Cl.
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

| | | | | |
|---|---|---|---|---|
| 8,511,818 | B2 * | 8/2013 | Nishikawa | G03G 15/60 347/108 |
| 11,006,010 | B2 | 5/2021 | Ota et al. | B41J 29/393 |
| 11,124,004 | B2 | 9/2021 | Umehara et al. | B41J 29/38 |
| 2007/0292159 | A1 * | 12/2007 | Iijima | G03G 21/1628 399/110 |
| 2009/0244249 | A1 | 10/2009 | Chinzei et al. | 347/108 |

FOREIGN PATENT DOCUMENTS

JP 2009-239752 10/2009

* cited by examiner

*Primary Examiner* — Justin Seo
*Assistant Examiner* — Tracey M McMillion
(74) *Attorney, Agent, or Firm* — Venable LLP

(57) ABSTRACT

A processing apparatus includes a housing that includes a frame member; a cover member configured to be pivotable between a closed position covering the housing and an open position opening the housing; a support member having a first end connected to the cover member and a second end connected to the frame member; a guide portion for guiding movement of the support member; an engaging portion configured to restrict movement of the second end of the support member caused by pivoting of the cover member; and a switching member configured to engage with the support member and be movable between a first position in which the engaging portion restricts movement of the second end of the support member and a second position in which the restriction of movement of the second end by the engaging portion is canceled.

17 Claims, 18 Drawing Sheets

PROCESSING APPARATUS

BACKGROUND OF THE INVENTION

Field of the Invention

The present invention relates to a processing apparatus.

Description of the Related Art

A recording apparatus may have a cover member in the upper part of the housing accommodating a recording portion that records images on recording media. The cover member opens and closes the housing to allow access to the recording portion. Such a cover member may have a reading portion that reads images from documents. The cover member or the cover member including the reading portion is pivotally coupled to the lower housing including the recording portion. A recording apparatus of such a configuration may have a mechanism that keeps the cover member lifted and opened to facilitate access to the inside of the apparatus in case when a recording medium being conveyed in the apparatus, such as paper, is jammed in the apparatus. For example, Japanese Patent Application Publication No. 2009-239752 describes a configuration including a lower housing and a cover member connected to the lower housing via a pivot portion. The cover member is opened relative to the lower housing about the axis of the pivot portion and is held by a support member connected to the cover member.

SUMMARY OF THE INVENTION

However, to close the open/close member of the configuration of the Japanese Patent Application Publication No. 2009-239752, the support member needs to be released from the lower housing. To this end, the user needs to simultaneously perform two actions of closing the cover member and pressing the stand by inserting a hand between the open/close member and the lower housing. This compromises the user operability. Additionally, an urging member is urged in the pivoting direction of the support member. This causes the cover member to be unintentionally closed when a force is applied to the support member by accident.

It is an objective of the present invention to provide a technique that stably maintains an open state of a cover member and cancels the open state with simple operations.

To achieve the above objective, a processing apparatus of the present invention includes:

a housing that accommodates a processing portion and includes a frame member;

a cover member supported by the housing so as to be pivotable between a closed position covering an upper part of the housing and an open position opening the upper part of the housing;

a support member having a first end connected to the cover member so as to be rotatable relative to the cover member and a second end connected to the frame member so as to be movable relative to the frame member;

a guide portion located in the frame member to guide movement of the second end of the support member;

an engaging portion configured to restrict movement of the second end of the support member caused by pivoting of the cover member from the open position to the closed position; and a switching member configured to engage with the support member and be movable between a first position in which the engaging portion restricts movement of the second end of the support member and a second position in which the restriction of movement of the second end by the engaging portion is canceled.

According to the present invention, it is possible to stably maintain an open state of a cover member and cancel the open state with simple operations.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Apparatus Configuration

Figure 1:
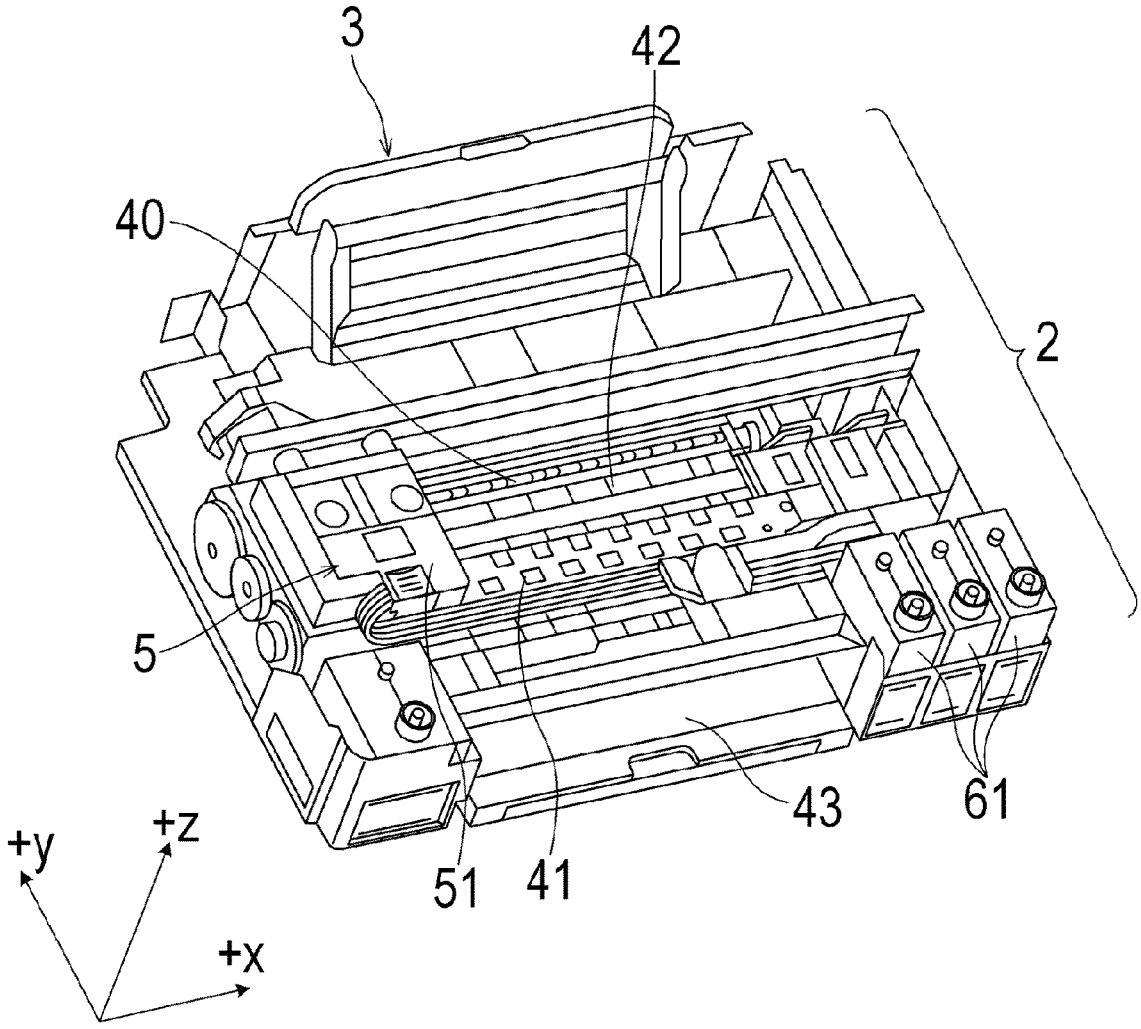
FIG. 1 is a perspective view showing a recording portion of a recording apparatus according to an embodiment of the present invention.

FIG. 1 is a perspective view showing the internal configuration, including a print portion (recording portion) 5, of an inkjet printer (recording apparatus) 1 according to a first embodiment of the present invention. The exterior portion of the recording apparatus 1 is omitted in FIG. 1. As shown in FIG. 1, the mechanical portion of the recording apparatus 1 is attached to a lower housing 2 of the apparatus main body. The rear side of the lower housing 2 as viewed in the +y direction includes a paper feed tray 3 for loading sheet materials as recording media. The top sheet of the sheet materials on the paper feed tray 3 is separated and fed to a conveying member (conveying roller) 40 by a feeding member and a conveyance passage (not shown). This sheet material is conveyed by the conveying member 40 and a paper discharge member (paper discharge roller) 41, which is driven synchronously with the conveying member 40, in the −y direction through the recording portion 5.

The recording portion 5 is located between the conveying member 40, which serves as a conveying portion, and the paper discharge member 41, and includes a recording head (not shown) and a carriage 51, which carries the recording head and reciprocates in directions perpendicular to the conveying direction of the sheet materials. Ink tanks 61 contain ink required for printing. The recording head records an image by discharging the ink supplied from the ink tanks 61 onto a sheet material based on the recording information. A platen 42, which guides and supports the sheet material while an image is being recorded, faces the recording portion 5 in the direction of gravity. The sheet material on which the image is recorded is discharged onto a paper discharge tray 43 provided outside the apparatus main body through the paper discharge member 41.

Access Operation

Figure 2:
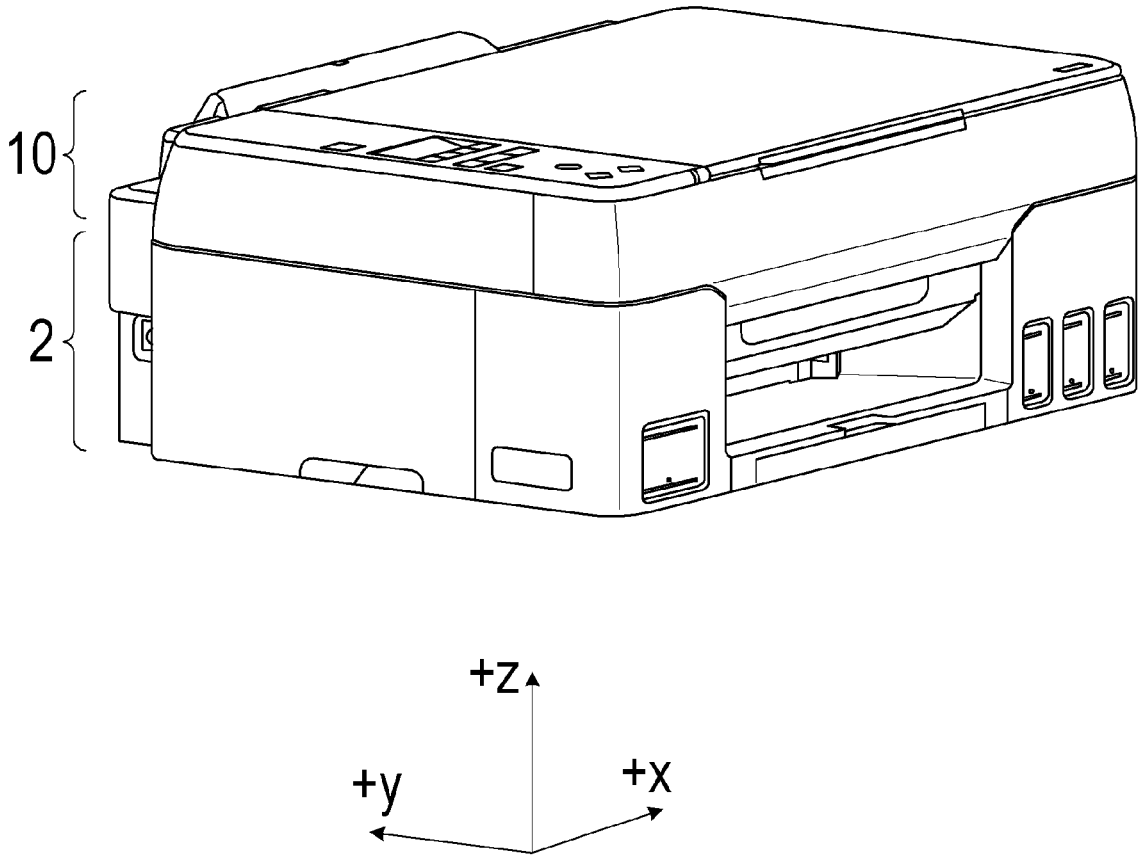
FIG. 2 is a perspective view showing the appearance of the recording apparatus according to the embodiment of the present invention.
Figure 3:
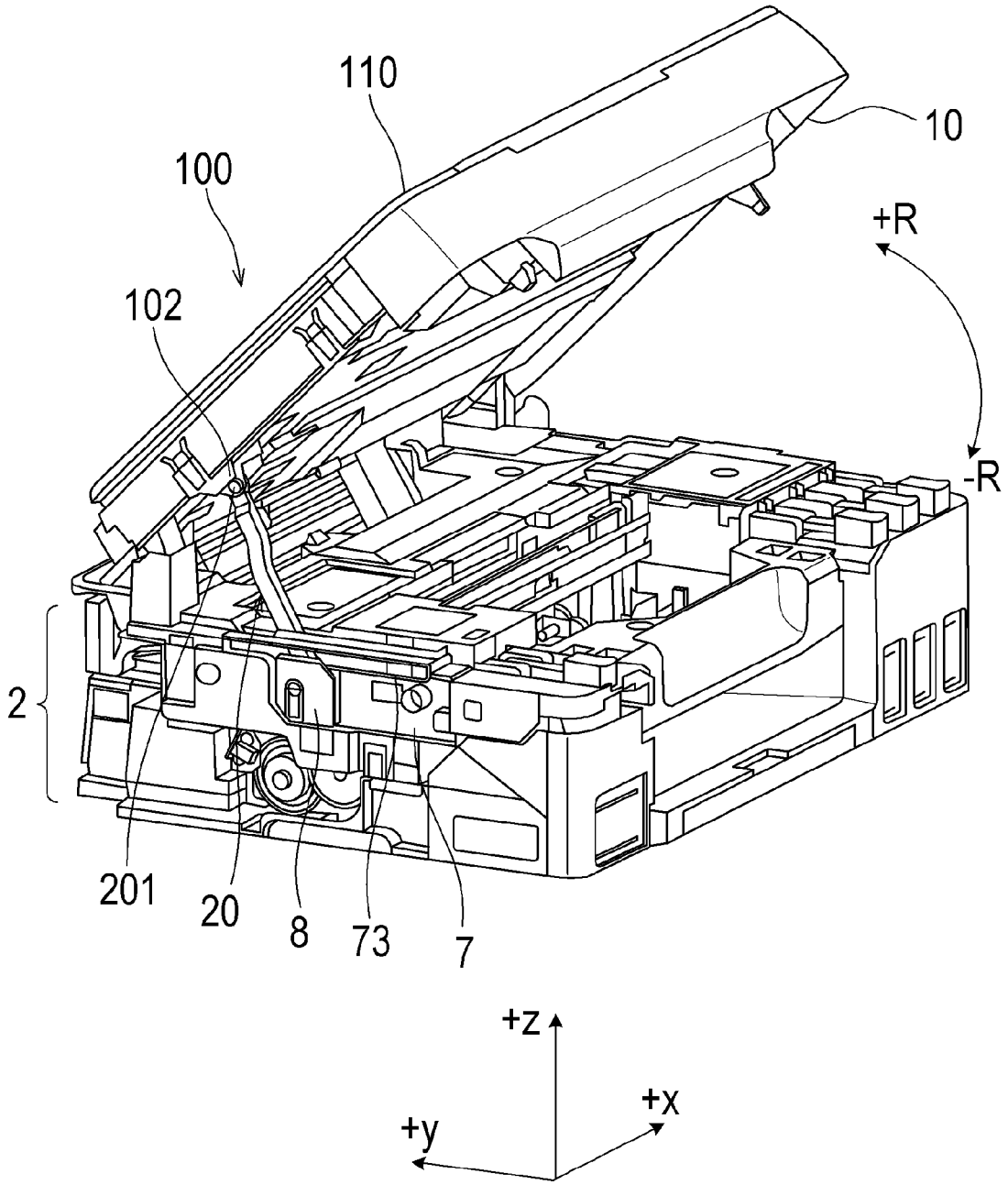
FIG. 3 is a perspective view of the recording apparatus with an access portion in an open state.

FIGS. 2 and 3 are schematic perspective views of the recording apparatus 1 according to the present embodiment. These perspective views schematically show a cover member 10 and a lower housing 2. FIG. 2 also shows the exterior portions of the cover member 10 and the lower housing 2 and a state in which the cover member 10 is closed with respect to the lower housing 2. The cover member 10 is coupled to the lower housing 2 via a pivoting shaft (not shown). The cover member 10 is supported by the lower housing 2 so as to be pivotable relative to the lower housing 2 about the pivoting shaft between a closed position that closes the upper part of the lower housing 2 and an open position that opens the upper part of the lower housing 2. FIG. 3 shows a state in which the cover member 10 is opened in the +R direction to allow access to the inside of the lower housing 2 so that the user can remove a sheet material jammed near the recording portion 5 or in the sheet conveyance passage or replace the recording head, for example. The edge on the apparatus front side of the cover member 10 is located higher than the edge on the apparatus rear side when the cover member 10 opens the upper part of the lower housing 2. The cover member 10 includes a reading portion 110, which reads images from documents.

As shown in FIG. 3, the cover member 10 has a pivoting shaft extending in the apparatus width direction (x-axis direction) on the apparatus rear side and is configured to pivot relative to the lower housing 2 about this pivoting shaft. The pivoting shaft is fitted into a bearing portion 75 (see FIG. 7A) in the frame member 7 of the lower housing 2. In addition to the pivoting shaft, the cover member 10 has a stay bearing 102 in its lower part. A stay 20, which serves as a support member, is coupled between the cover member 10 and the lower housing 2. The cover member 10 is configured to be supported by the stay 20 to be held in an open position relative to the lower housing 2. A first end of the stay 20 is rotationally attached to the cover member 10, and a second end is attached to the frame member 7 so as to be movable in predetermined sliding directions. The stay bearing 102 is engaged with a stay shaft 201 provided in the first end of the stay 20 in a predetermined fitted state. The stay shaft 201 substantially extends in the x-axis direction (substantially horizontal direction). The second end of the stay 20 is in contact with a rail portion 73 of the frame member 7 of the lower housing 2, which will be described below. The stay bearing 102 is configured such that the stay shaft 201 engages with an elongated shaft hole. That is, the stay shaft 201 and the stay bearing 102 are substantially in a fitted state in a first direction of bearing radial directions (directions along a plane perpendicular to the stay shaft 201), but are in a non-fitted state and separated from each other by a gap in a second direction that is a bearing radial direction perpendicular to the first direction. This is to avoid seizing that would otherwise occur when the cover member 10 is opened and closed because the position where the first end of the stay 20 is fitted with the cover member 10 is offset in the direction of the stay shaft 201 from the position where the second end of the stay 20 engages with the frame member 7 or an opening member 8, which will be described below. The direction in which the stay shaft 201 and the stay bearing 102 are loosely fitted is appropriately set so as to achieve smooth opening and closing of the cover member 10. The pivoting shaft and the bearing portion, and the stay bearing 102 and the stay shaft 201 may be interchanged in terms of the members in which they are formed. That is, the pivoting shaft may be provided in one of the cover member 10 and the first end of the stay 20, and the bearing portion may be provided in the other of the cover member 10 and the first end of the stay 20.

Figure 4:
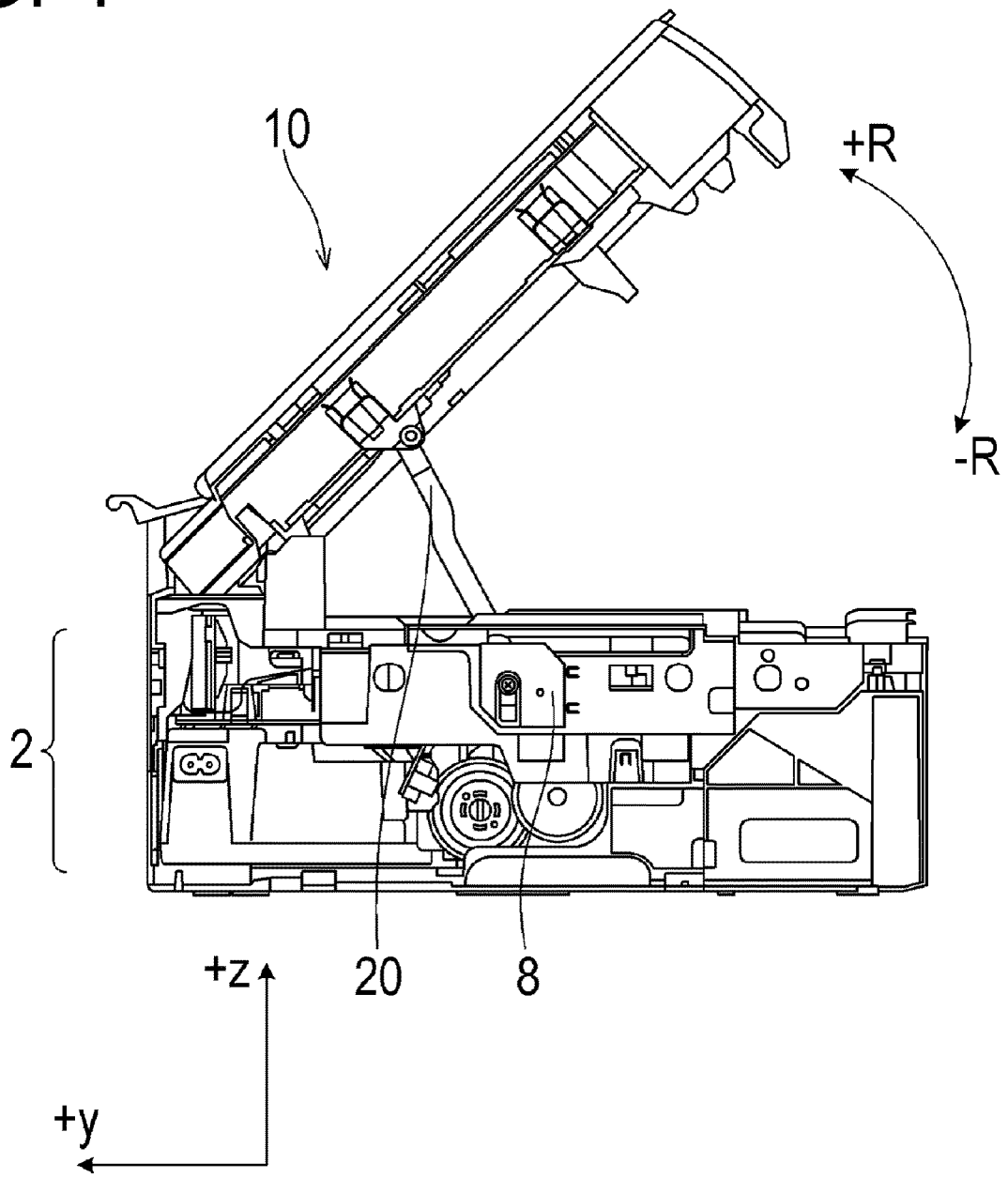
FIG. 4 is a side view of the recording apparatus with the access portion in the open state.
Figure 5:
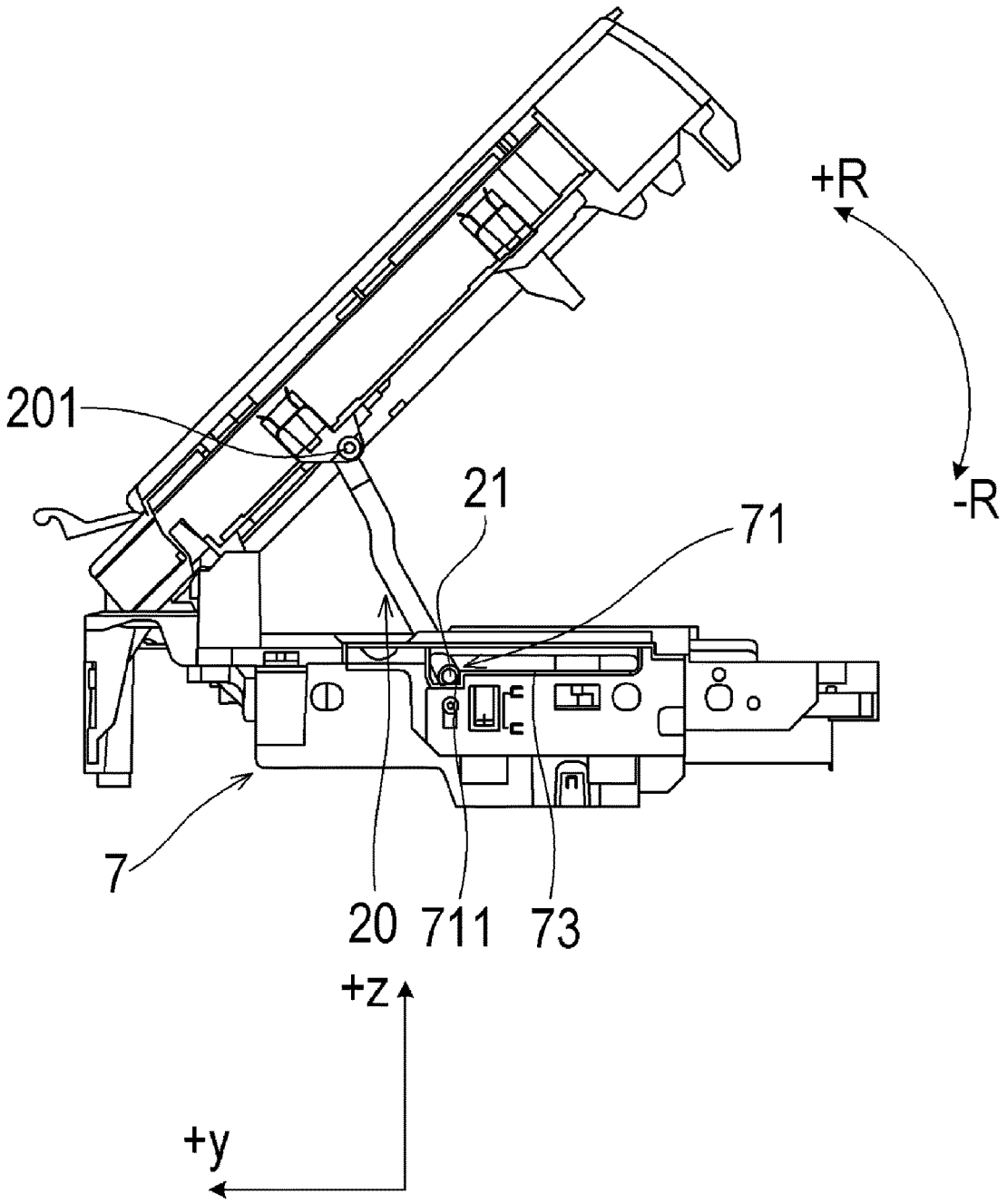
FIG. 5 is a partially enlarged side view of the recording apparatus with the access portion in the open state.

Referring to FIGS. 4 and 5, the holding mechanism of the cover member 10 is now described. FIGS. 4 and 5 show the cover member 10 held in an open state. FIG. 5 is a diagram illustrating that the second end of the stay 20 is engaged by the frame member 7 so that the cover member 10 is held in the open state. As shown in FIG. 5, the stay 20 has, in its second end, a holding portion 21, which is a boss portion protruding substantially in the −x direction (substantially horizontally). The holding portion 21 is substantially parallel to the stay shaft 201 described above. The frame member 7 has a holding contact portion 71 configured to be in contact with the holding portion 21 of the stay 20 in a direction perpendicular to the x-axis direction. A holding contact surface 711 is formed as a part of a rail portion 73 and located in a position facing the holding portion 21 in the direction of gravity with respect to the cover member 10 and in the rotation directions of the stay 20. The holding contact surface 711 stops the holding portion 21 so that the second end of the stay 20 is locked to the frame member 7, thereby holding the cover member 10 in the open state (open position) relative to the lower housing 2. That is, the holding contact surface 711 is configured to engage with the holding portion 21 of the stay 20 so as to allow the cover member 10 to move from the closed state to the open state and stop the cover member 10 from moving from the open state to the closed state.

Opening Member (Switching Member)

Figure 6B:
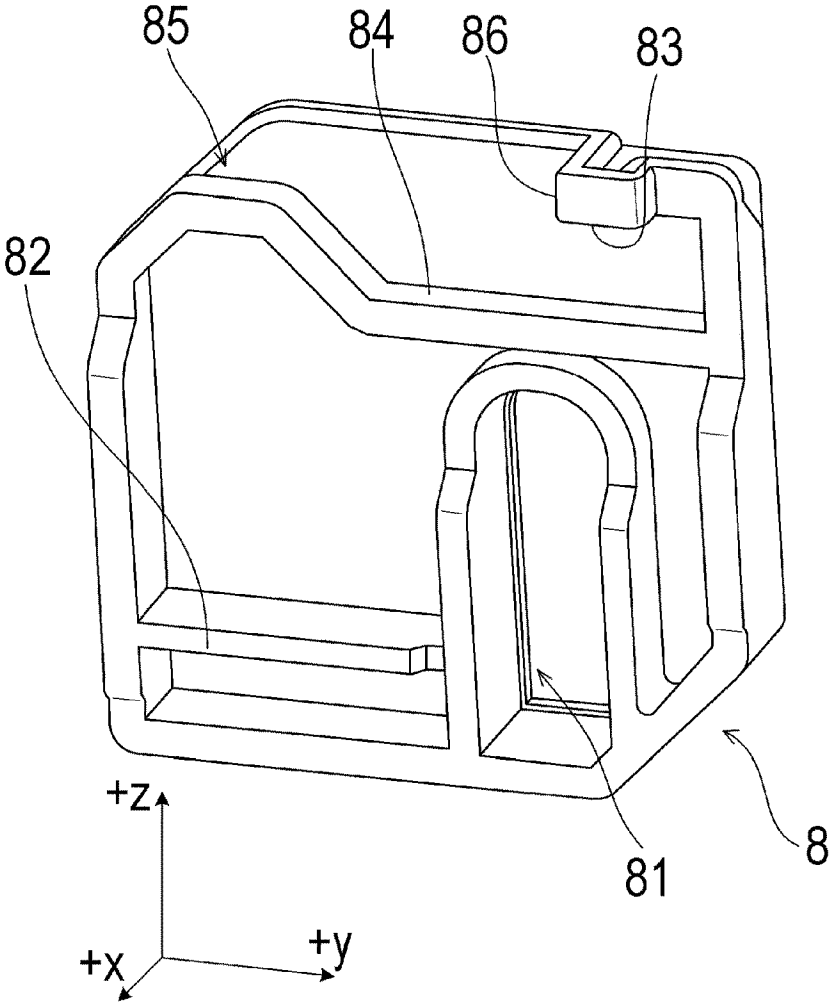
FIGS. 6A and 6B are perspective views of an opening member.
Figure 6A:
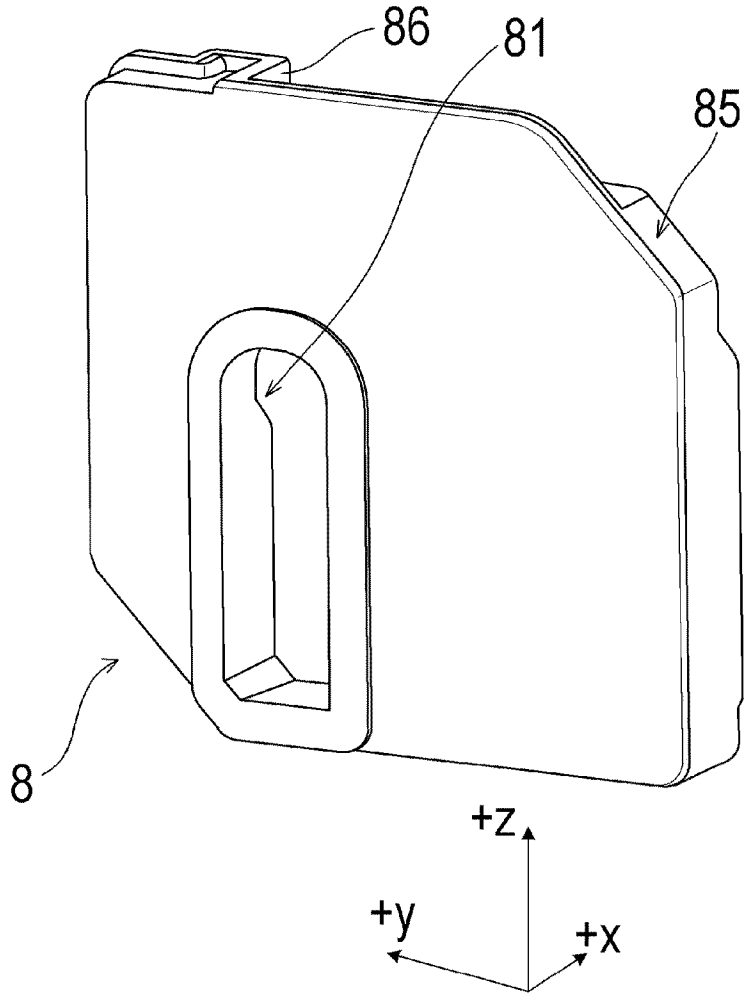
Figure 7A:
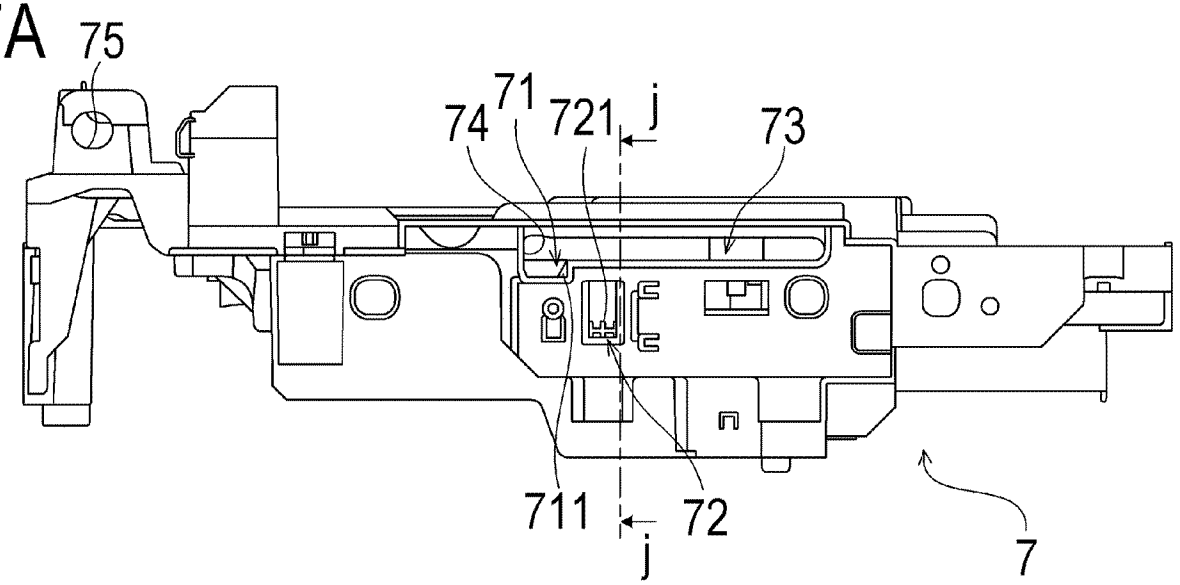
FIGS. 7A are 7B are a side view and a cross-sectional view of a frame member.
Figure 7B:
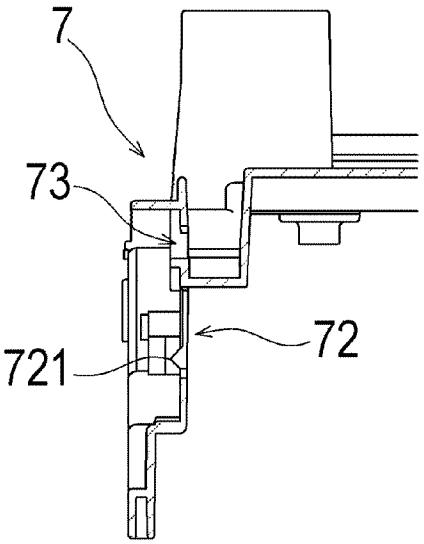
Figure 8A:
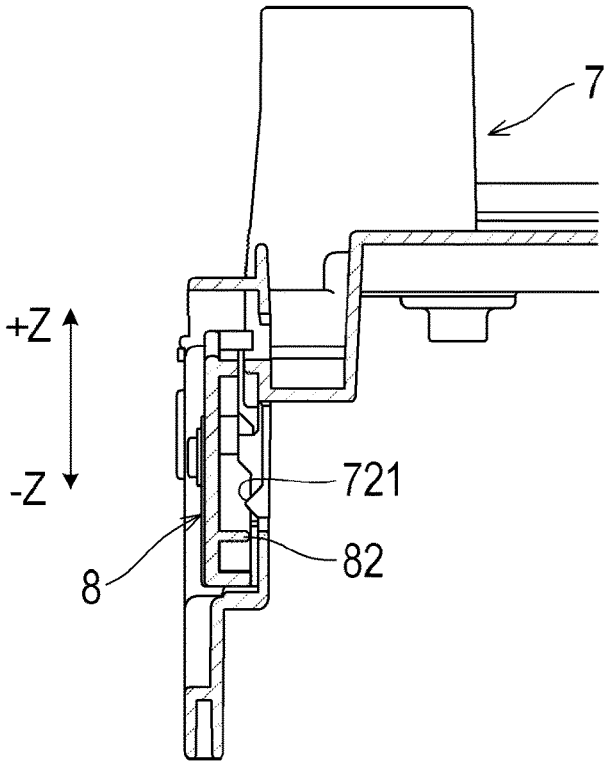
FIGS. 8A and 8B are cross-sectional views showing positions of the opening member relative to the frame member.
Figure 8B:
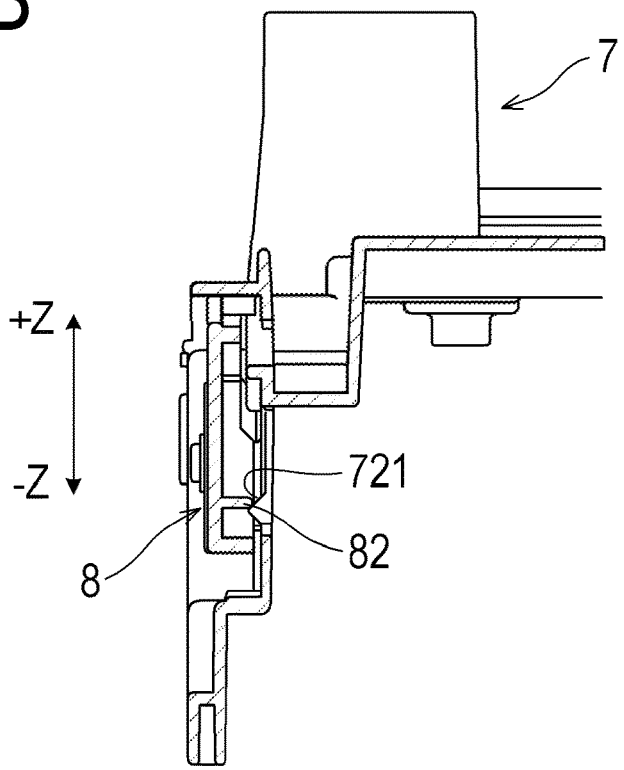

FIGS. 6A and 6B are perspective views of an opening member 8, which serves as a switching member, of the present embodiment. FIGS. 7A and 7B are a side view and a cross-sectional view of the frame member 7. FIGS. 8A and 8B are cross-sectional views taken along line j-j in FIG. 7A to show the two positions that the opening member 8 can assume relative to the frame member 7.

As shown in FIGS. 6A and 6B, the opening member 8 has a position guide portion 81, which is in contact with the frame member 7 and guides vertical movements between a first position and a second position, and an urged portion 82, which is urged by an urging portion 72 of the frame member 7 described below to maintain the second position. The frame member 7 has a guide protruding portion 78 (see FIGS. 9A and 9B), which engages with the position guide portion 81. The guide protruding portion 78 determines the position of the opening member 8 in the y-axis direction relative to the side surface of the frame member 7 and also limits the slide movement range of the opening member 8 in the up-down direction relative to the side surface of the frame member 7. The frame member 7 also has guide protrusions 79, which extend from the side surface and are in contact with a side surface of the opening member 8 to guide slide movements of the opening member 8 (see FIGS. 9A and 9B).

The opening member 8 also includes a position switching portion 83, which serves as a first action-receiving portion. When the cover member 10 is further pivoted from its open state in the +R direction, the position switching portion 83 comes into contact with the holding portion 21 of the stay 20 and receives a force acting in the direction from the first position to the second position. The opening member 8 also includes a rail connection portion 84, which guides the movement of the stay 20 when the cover member 10 is pivoted in the −R direction from the open state. The rail connection portion 84 is a switching rail portion that forms a guide passage for guiding movement of the holding portion 21 of the stay 20 together with the rail portion 73, which serves as a guide portion or a guide rail portion described below. The rail connection portion 84 and the rail portion 73 are offset from each other in the protruding direction of the holding portion 21, and form a guide passage with which the holding portion 21 engages so as to be slidable in substantially horizontal directions perpendicular to the protruding direction. When the opening member 8 is in the first position, the rail connection portion 84 is displaced downward from the rail portion 73 (first relative position), so that the rail connection portion 84 forms, together with the rail portion 73, a first guide passage with which the holding contact surface 711, which is an engaging portion described below, is exposed to the guide passage. That is, a guide passage is formed in which the holding contact surface 711 extends between the different levels of the rail portion 73 and the rail connection portion 84. When the cover member 10 is opened from the closed state and the holding portion 21 is moved to or beyond the holding contact surface 711, the holding contact surface 711 can restrict the holding portion 21 in the guide passage. When the opening member 8 is in the second position, the rail connection portion 84 is located at substantially the same height as the rail portion 73 (second relative position) and forms, together with the rail portion 73, a second guide passage with which the holding contact surface 711 is retracted out of the guide passage.

Furthermore, the opening member 8 includes a canceling portion 85, which serves as a second action-receiving portion and receives a force from the stay 20 in a direction that cancels the urging by the urging portion 72 while the stay 20 moves along the rail portion 73 in the −y direction. The opening member 8 also includes an abutting portion 86, which abuts the holding portion 21 when the cover member 10 is pivoted in the opening direction from the closed state.

As shown in FIGS. 7A and 7B, the frame member 7 includes the holding contact portion 71, which comes into contact with the stay 20 to maintain the position of the stay 20 holding the cover member 10 in the open state, and an urging portion 72, which holds the opening member 8 in the second position. Additionally, the frame member 7 includes the rail portion 73, which extends substantially horizontally and guides the holding portion 21 of the stay 20 pivoting in synchronization with the opening or closing cover member. The rail portion 73 limits vertical positions of the holding portion 21. The frame member 7 also includes a restriction portion 74, which restricts movement of the stay 20 in the +y direction, and the bearing portion 75, which supports the cover member 10.

FIG. 8A shows a state in which the opening member 8 is lowered by its own weight, and this state is referred to as a first position in this embodiment. FIG. 8B shows a state in which the opening member 8 has moved over a projection 721 of the urging portion 72 and is in contact with the urging portion 72. The opening member 8 is held in a position higher than the first position in the gravitational direction. This position is referred to as a second position in this embodiment. The illustrated urging portion 72 has a cantilever structure with the projection 721 at its distal end, and forms a snap-fit configuration. When the opening member 8 moves between the first and second positions, the projection 721 comes into contact with the urged portion 82 and receives a force from the urged portion 82. This deforms the entire urging portion 72 in a horizontal direction away from the urged portion 82, allowing the opening member 8 to move between the two positions. That is, the opening member 8 is configured to be movable between two positions by receiving a force that overcomes the urging force of the urging portion 72 in an opening or closing operation of the cover member 10. The urging portion 72 is configured such that the weight of the opening member 8 and the weight of the stay 20 only cause imperceptible deformation of the urging portion 72. The opening member 8 is configured so as not to be moved from the second position to the first position unless a predetermined external force is applied to the opening member 8. That is, the present embodiment is configured such that the deformation that enables the opening member 8 to move between the positions occurs when the weight of the cover member 10 or a force for lifting the cover member 10 is applied to the opening member 8 via the stay 20.

Referring to FIGS. 9A and 9B to FIGS. 18A to 18B, the procedures of opening, closing, and holding the cover member 10 are now described.

Figure 9A:
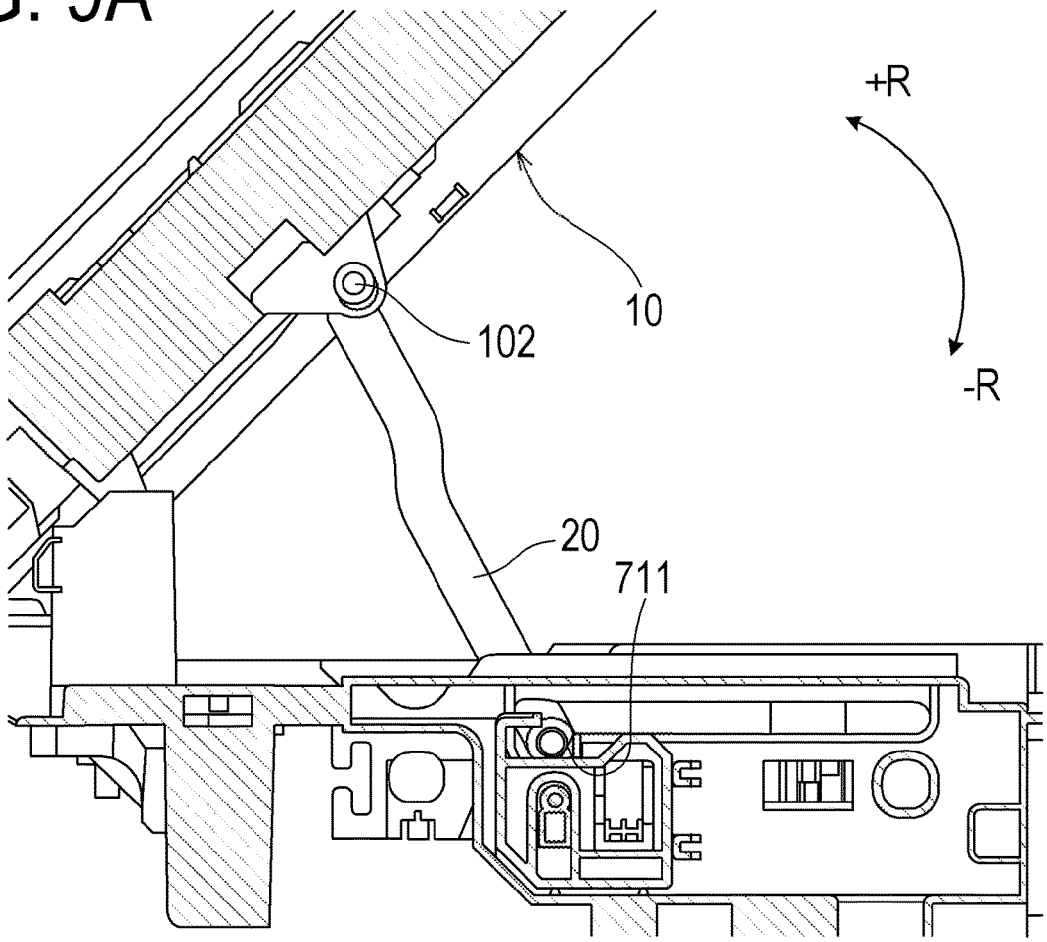
FIGS. 9A and 9B are side cross-sectional views showing a first position of the opening member with the access portion in the open state.
Figure 9B:
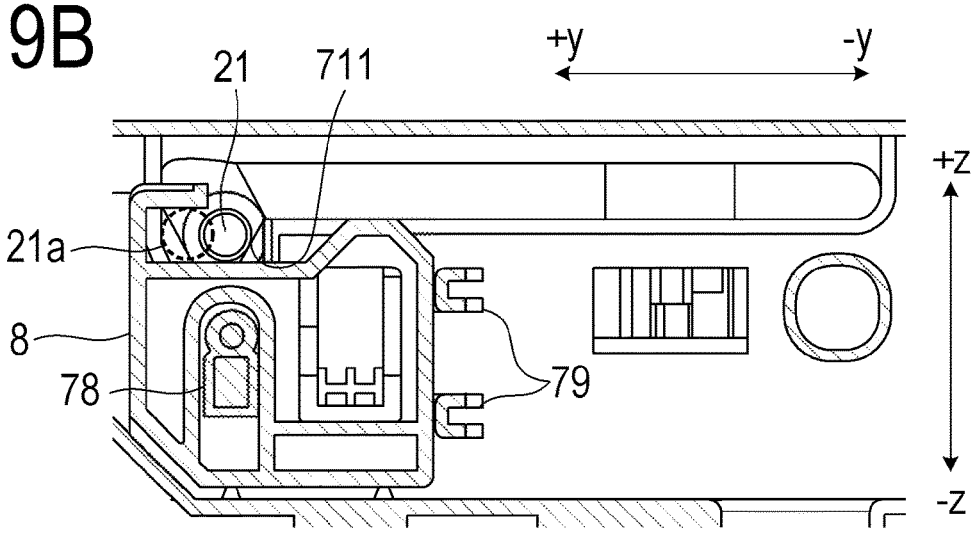
Figure 10A:
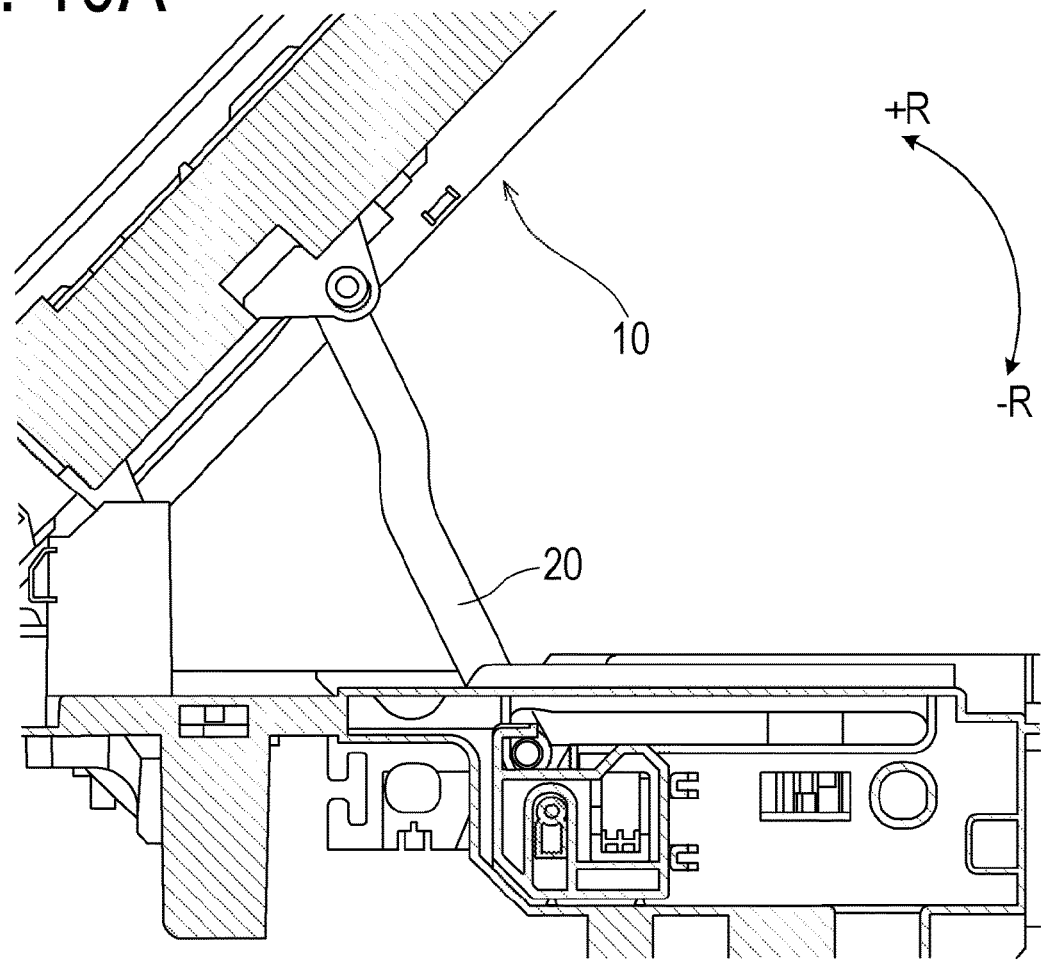
FIGS. 10A and 10B are side cross-sectional views showing movement of the support member in a process of closing the access portion.
Figure 10B:
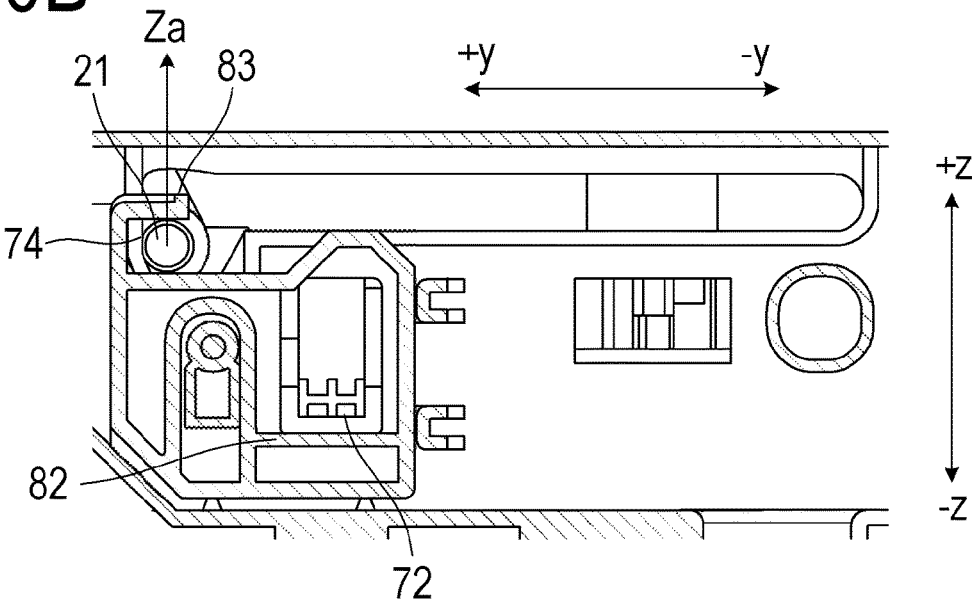
Figure 11:
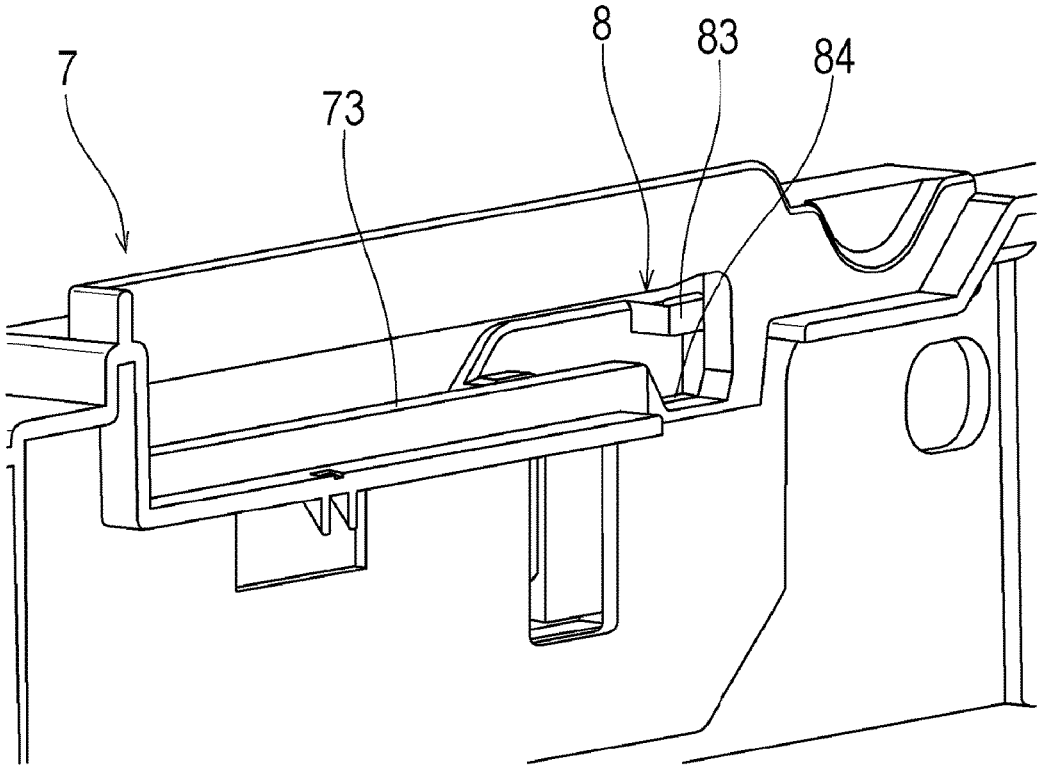
FIG. 11 is a cross-sectional perspective view of the opening member and the frame member in a process of closing the access portion.

FIG. 9A is a side cross-sectional view of the cover member 10, the opening member 8, the stay 20, and the frame member 7 in a state in which the cover member 10 is held in the open state. FIG. 9B is an enlarged view around the opening member 8. FIG. 10A is a side cross-sectional view of the cover member 10, the opening member 8, the stay 20, and the frame member 7 in a state in which the cover member 10 is further pivoted in the +R direction from the open state shown in FIGS. 9A and 9B. FIG. 10B is an enlarged view around the opening member 8. FIG. 11 is a cross-sectional perspective view as viewed from the +x direction side to the −x direction side, showing the frame member 7 and the opening member 8 in the first position. FIG. 11 does not show the stay 20 in FIGS. 10A and 10B.

Figure 12A:
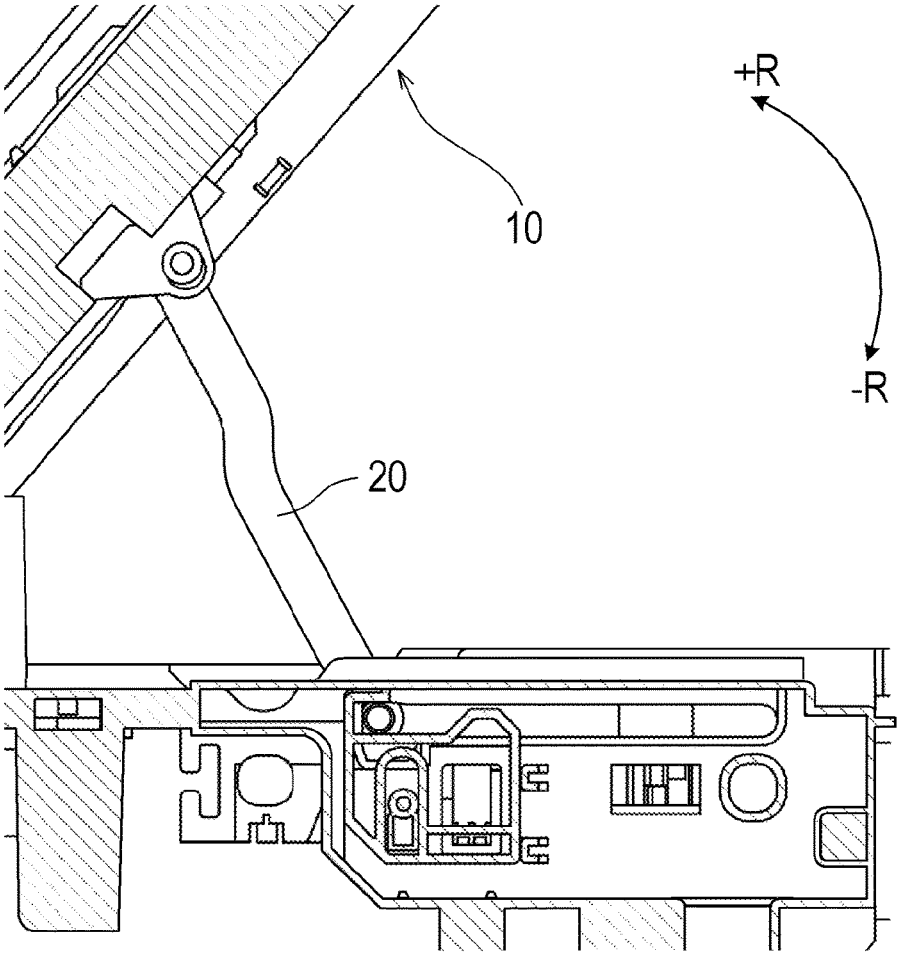
FIGS. 12A and 12B are side cross-sectional views showing a second position of the opening member in a process of closing the access portion.
Figure 12B:
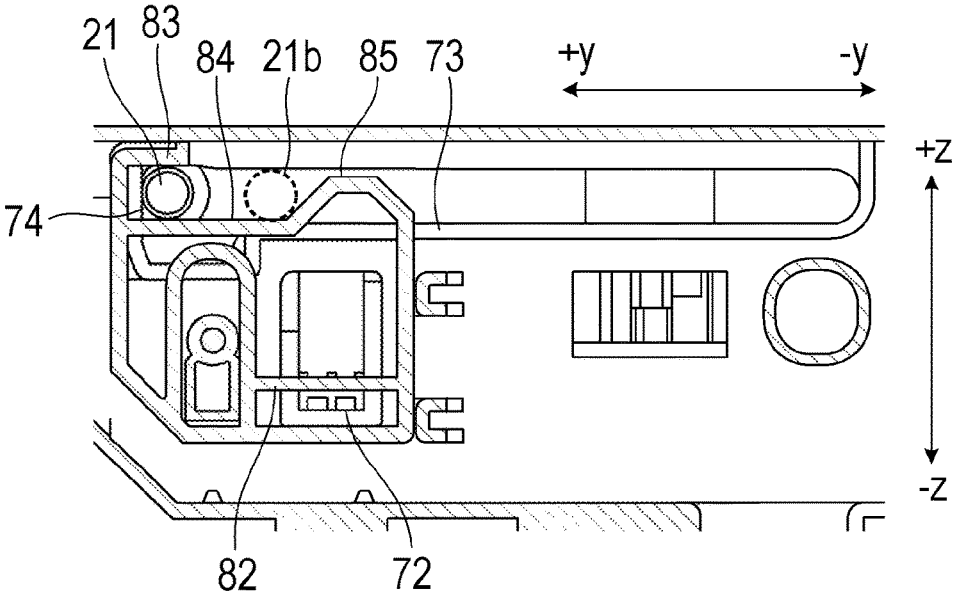
Figure 13:
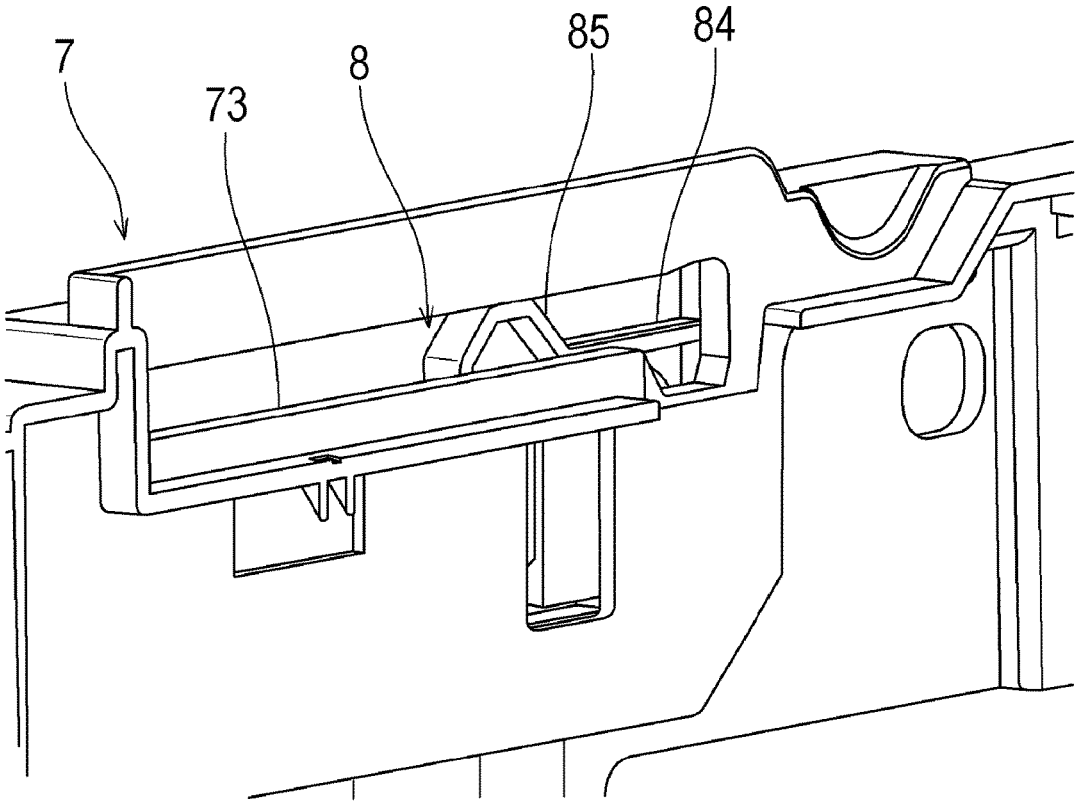
FIG. 13 is a cross-sectional perspective view showing the second position of the opening member in a process of closing the access portion.

FIG. 12A is a side cross-sectional view of the cover member 10, the opening member 8, the stay 20, and the frame member 7 in a state in which the cover member 10 is further pivoted from the position in FIGS. 10A and 10B in the +R direction and the opening member 8 is moved to the second position. FIG. 12B is an enlarged view around the opening member 8. FIG. 13 is a cross-sectional perspective view as viewed from the +x direction side to the −x direction side, showing the frame member 7 and the opening member 8 in the second position. FIG. 13 does not show the stay 20 in FIGS. 12A and 12B.

Figure 14A:
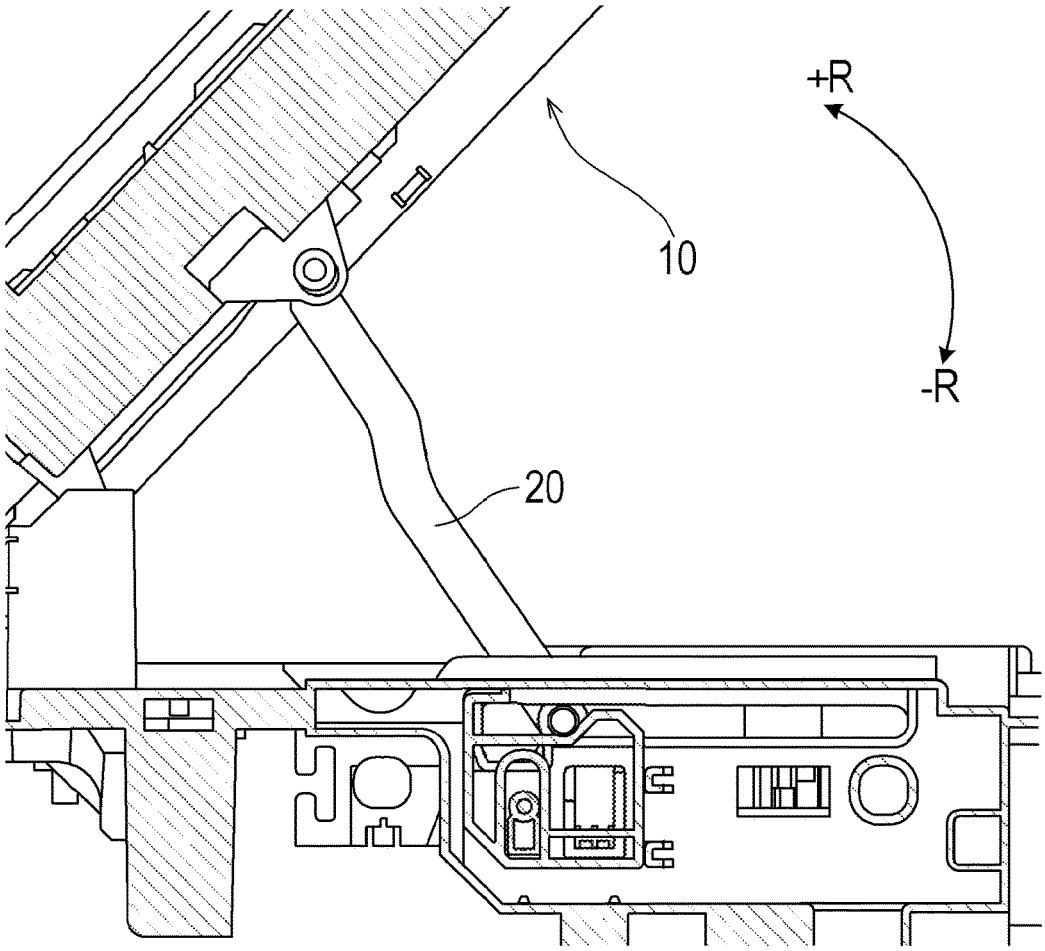
FIGS. 14A and 14B are side cross-sectional views showing the second position of the opening member in a process of closing the access portion.
Figure 14B:
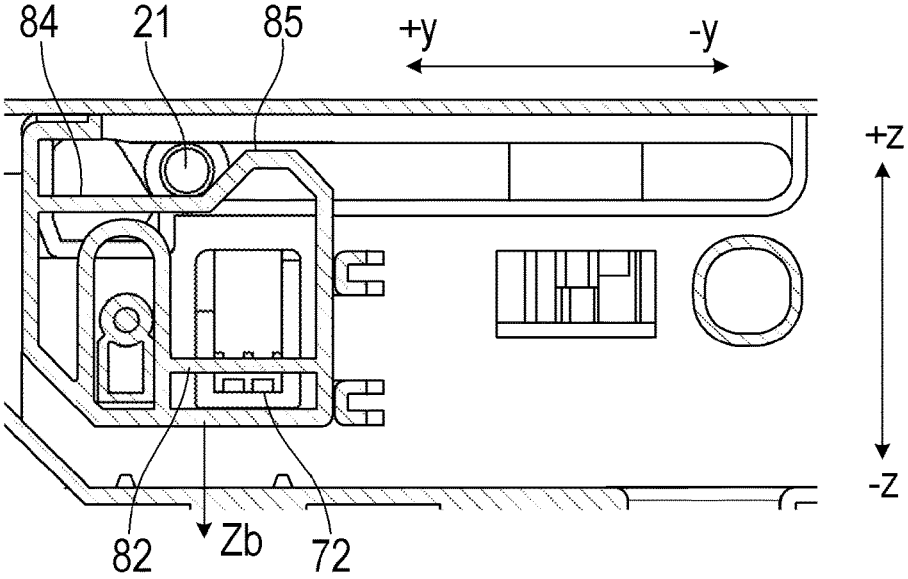
Figure 15A:
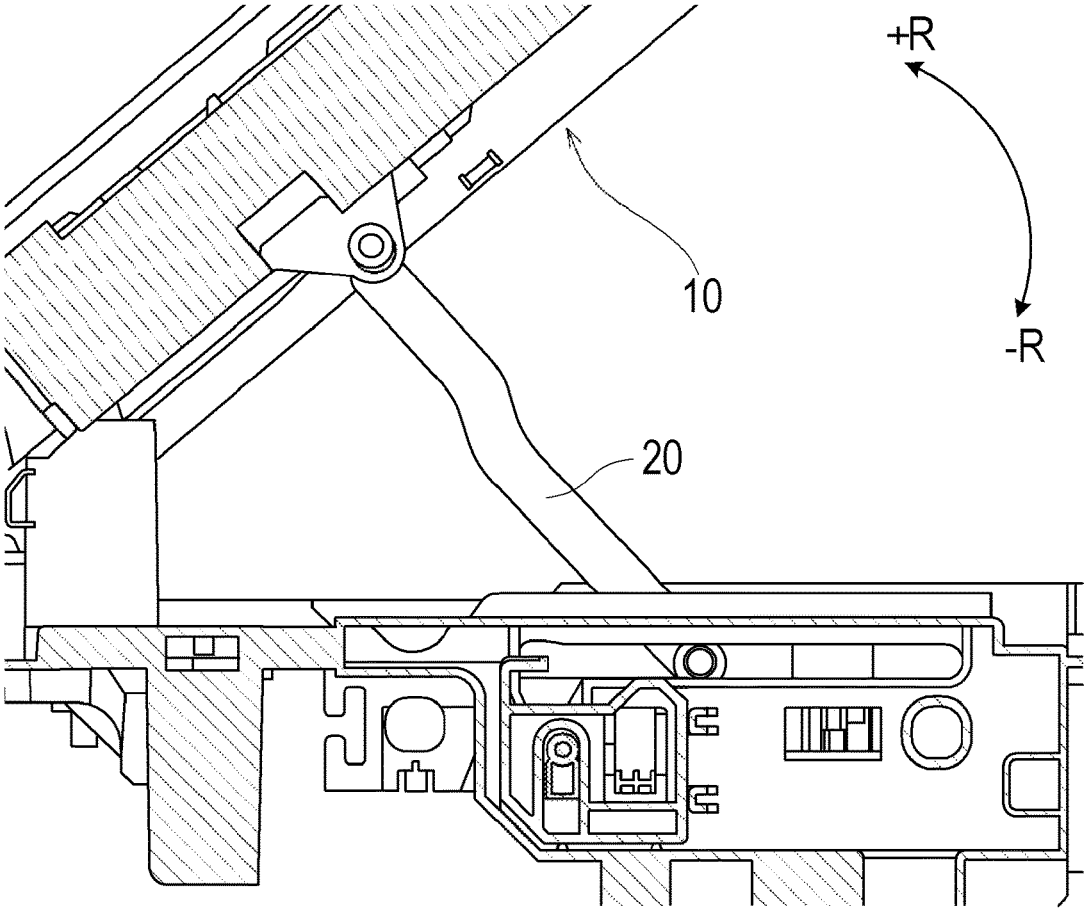
FIGS. 15A and 15B are side cross-sectional views showing the first position of the opening member in a process of closing the access portion.
Figure 15B:
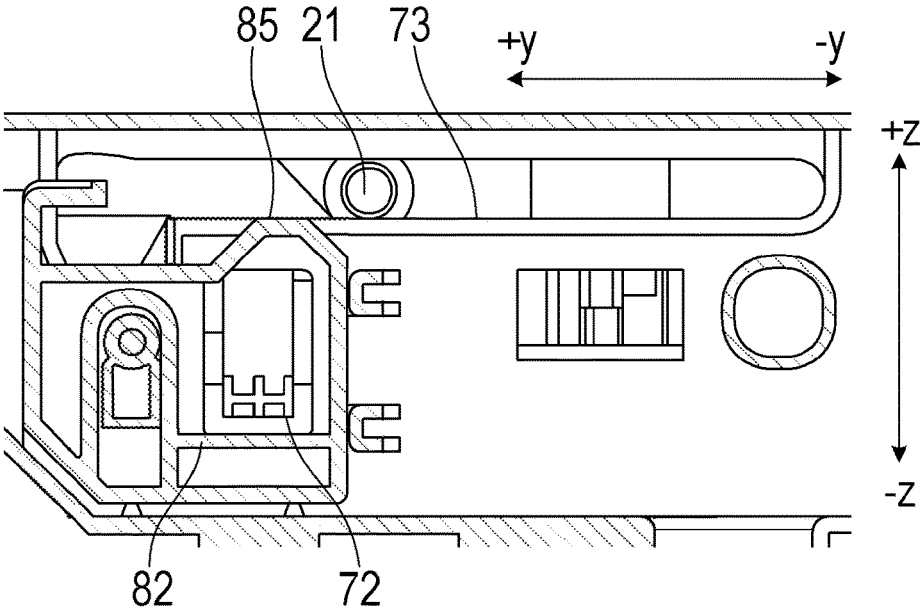
Figure 16A:
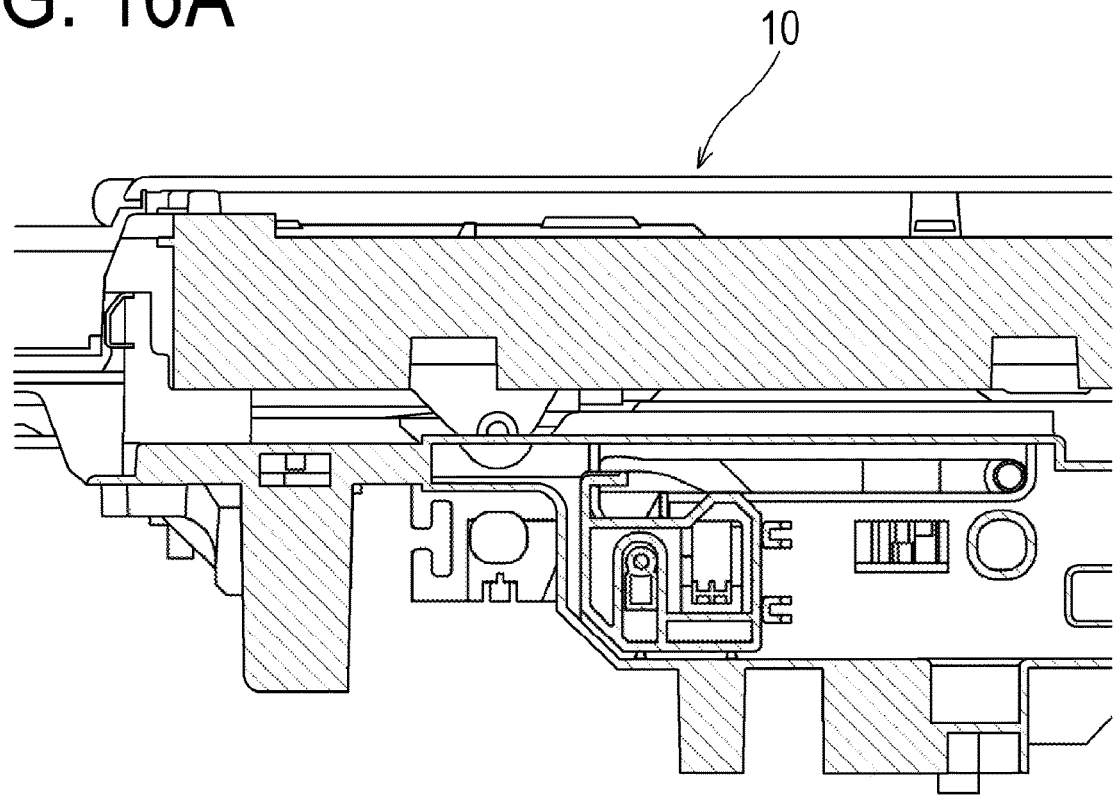
FIGS. 16A and 16B are side cross-sectional views showing the position of the support member with the access portion closed.
Figure 16B:
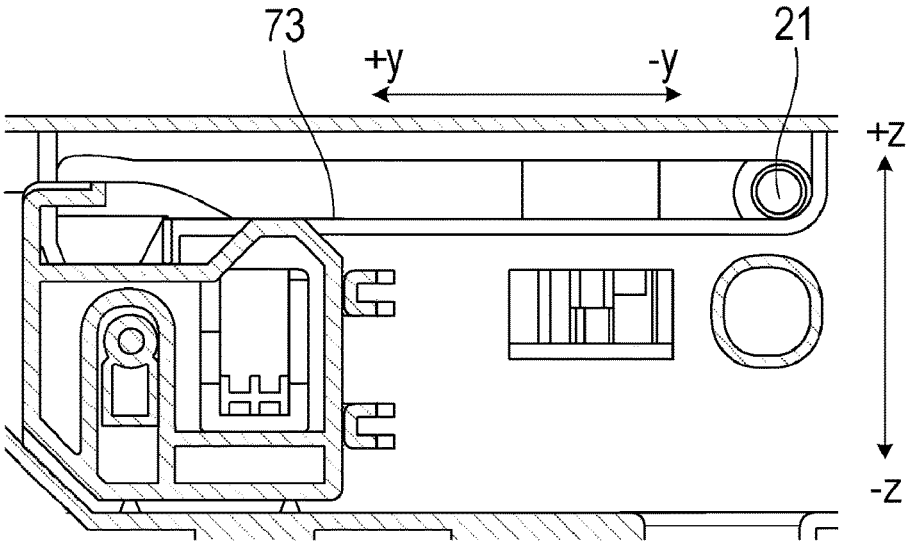

FIG. 14A is a side cross-sectional view of the cover member 10, the opening member 8, the stay 20, and the frame member 7 in a state in which the cover member 10 is pivoted from the state in FIGS. 12A and 12B in the −R direction. FIG. 14B is an enlarged view around the opening member 8. FIG. 15A is a side cross-sectional view of the cover member 10, the opening member 8, the stay 20, and the frame member 7 in a state in which the cover member 10 is further pivoted from the position in FIGS. 14A and 14B in the −R direction and the opening member 8 is moved to the first position from the second position. FIG. 15B is an enlarged view around the opening member 8. FIG. 16A is a side cross-sectional view of the cover member 10, the opening member 8, the stay 20, and the frame member 7 in a state in which the cover member 10 is in the closed state. FIG. 16B is an enlarged view around the opening member 8.

As shown in FIGS. 9A and 9B, the holding portion 21 of the stay 20 is in contact with the holding contact surface 711 of the frame member 7. The holding portion 21 receives from the holding contact surface 711 a reaction force against the weight of the cover member 10, so that the cover member 10 is held in the open state. The opening member 8 is in the first position. The holding contact surface 711 is located in the −y direction of the stay bearing 102 as viewed in FIGS. 9A and 9B. When the cover member 10 is pivoted in the +R direction from this held open state, the holding portion 21 of the stay 20 moves in the +y direction by its own weight to the position indicated by broken line 21*a* in FIG. 9B. The cover member 10 is thus moved into a state shown in FIGS. 10A and 10B. The members including the stay bearing 102 and the holding contact surface 711 may be interchanged. That is, the positional relationship may be the opposite.

As shown in FIGS. 10A and 10B, the holding portion 21 comes into contact with the restriction portion 74 of the frame member 7 and is restricted from moving in the +y direction. As such, when the cover member 10 is further pivoted in the +R direction (opening direction), the holding portion 21 moves in the direction of arrow Za in FIG. 10B together with the opening member 8 to a position shown in FIGS. 12A and 12B. As shown in FIGS. 12A and 12B, the holding portion 21 moves in the +z direction in contact with the position switching portion 83 of the opening member 8, and the urged portion 82 moves over the urging portion 72 so that the opening member 8 is moved from the first position to the second position.

As shown in FIG. 11, the rail connection portion 84 of the opening member 8 in the first position is discontinuous with the rail portion 73 of the frame member 7. As shown in FIG. 13, when the opening member 8 is in the second position, the rail connection portion 84 forms a plane substantially continuous with the rail portion 73 of the frame member 7, so that the opening member 8 guides the holding portion 21 to the rail portion 73. The holding portion 21 as shown in FIGS. 12A and 12B moves substantially horizontally to the position indicated by broken line 21*b* when the cover member 10 pivots in the −R direction. The holding portion 21 moves in the −y direction on the rail connection portion 84 and the rail portion 73 to a position where the holding portion 21 comes into contact with the canceling portion 85 as shown in FIGS. 14A and 14B. After coming into contact, the holding portion 21 applies a force that moves the opening member 8 from the second position to the first position in the direction of Zb with the weight of the cover member 10. The force of the urged portion 82 of the opening member 8 releases the urging portion 72, allowing the opening member 8 to move to the first position as shown in FIGS. 15A and 15B. The opening member 8 is maintained in the first position by its own weight. When the cover member 10 is further pivoted in the −R direction from the position shown in FIGS. 15A and 15B, the holding portion 21 moves in the −y direction in contact with the rail portion 73. As shown in FIGS. 16A and 16B, the holding portion 21 is accommodated in the rail portion 73 when the cover member 10 is completely closed.

Figure 17A:
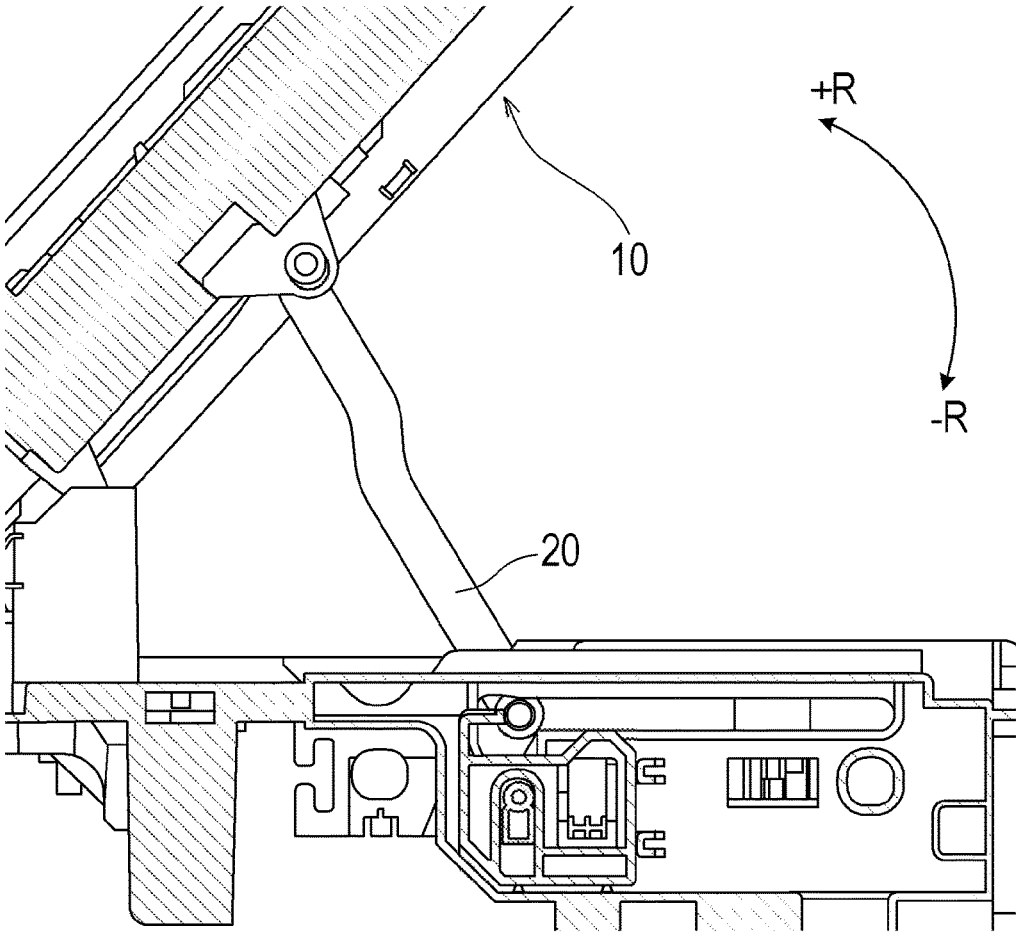
FIGS. 17A and 17B are side cross-sectional views showing the position of the support member with the access portion opened.
Figure 17B:
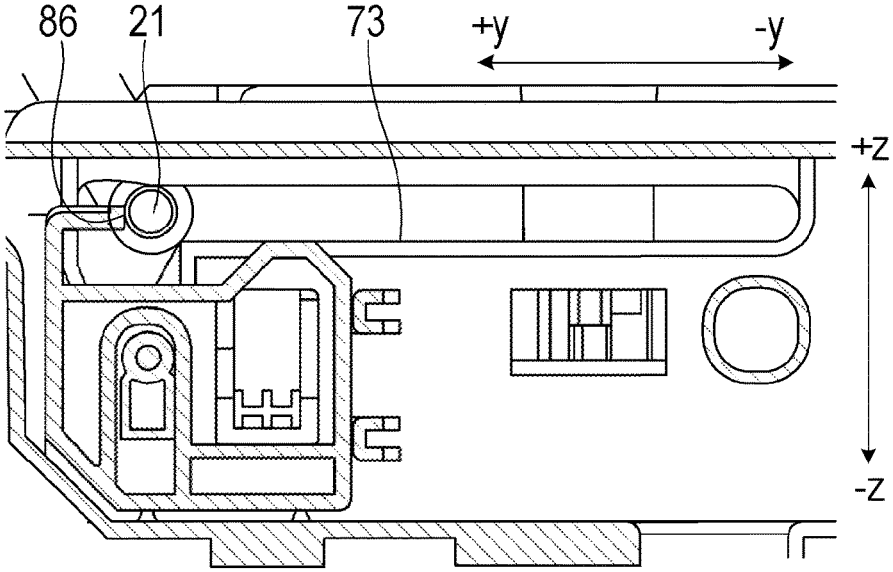

FIG. 17A is a side cross-sectional view of the cover member 10, the opening member 8, the stay 20, and the frame member 7 in a state in which the cover member 10 is completely pivoted to the open state from the closed state. FIG. 17B is an enlarged view around the opening member 8.

As the cover member 10 is pivoted in the +R direction from the closed state, the holding portion 21 moves in the +y direction along the rail portion 73 and then abuts the abutting portion 86 of the opening member 8 as shown in FIGS. 17A and 17B. When the cover member 10 is pivoted in the −R direction after the holding portion 21 abuts the abutting portion 86, the holding portion 21 moves in the +y direction and the −z direction by its own weight. The holding portion 21 thus moves to the state shown in FIGS. 9A and 9B.

Figure 18A:
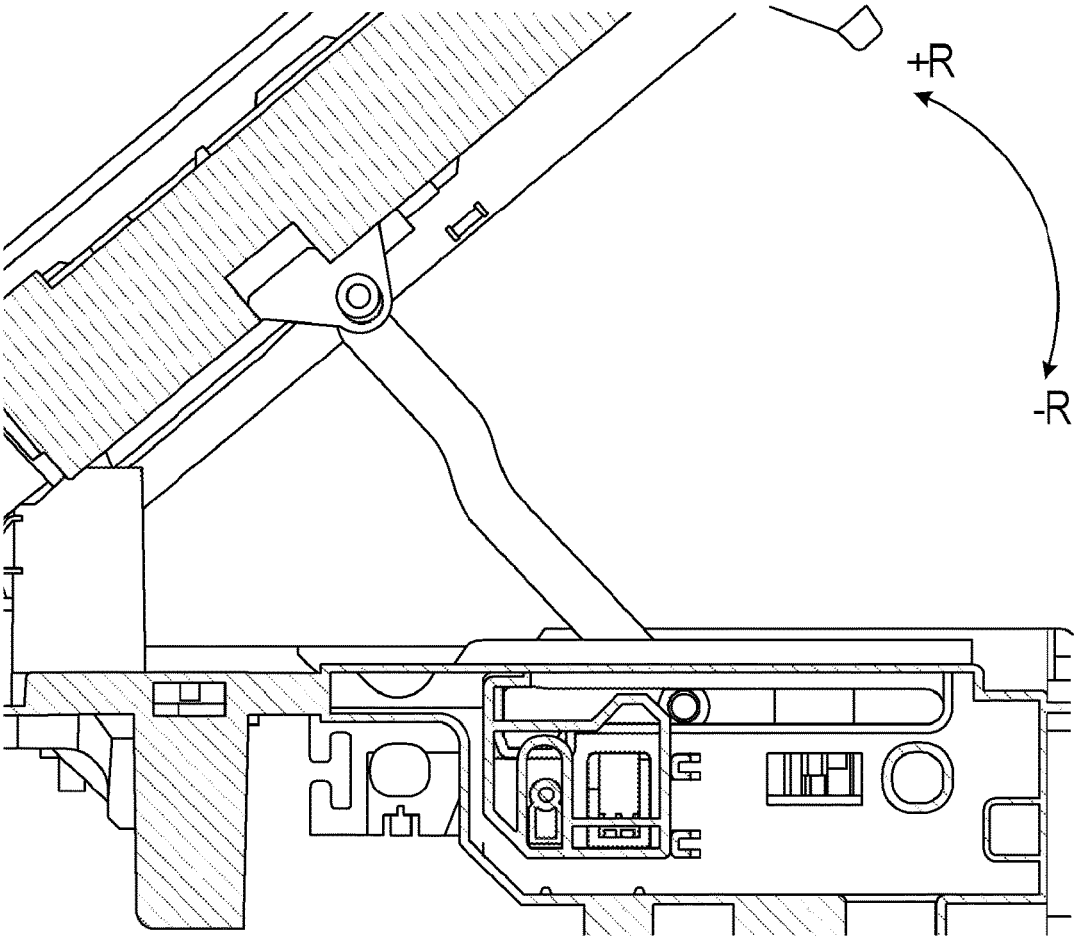
FIGS. 18A and 18B are side cross-sectional views showing the opening member in the second position in a process of opening the access portion.
Figure 18B:
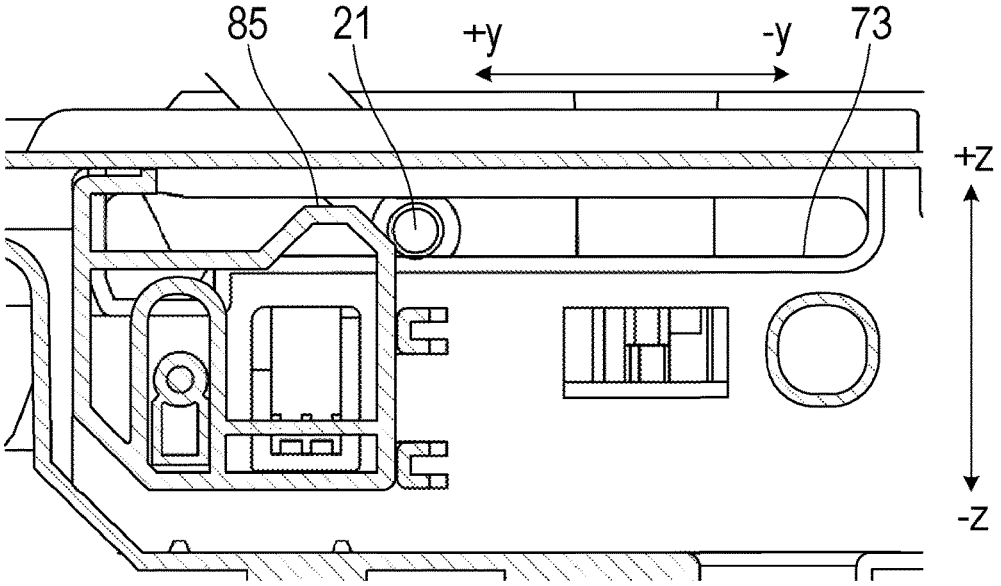

Referring to FIGS. 18A and 18B, a situation is now described in which the cover member 10 is in the closed state and the opening member 8 is in the second position during assembly, for example. FIG. 18A is a side cross-sectional view of the cover member 10, the opening member 8, the stay 20, and the frame member 7 in a state in which the cover member 10 is being pivoted toward the open state from the closed state. FIG. 18B is an enlarged view around the opening member 8. When the cover member 10 is pivoted in the +R direction from the closed state, the holding portion 21 moves substantially horizontally from the −y direction side toward the +y direction side to a position where it comes into contact with the canceling portion 85. After coming into contact, the force for lifting the cover member 10 causes the holding portion 21 to apply a force that moves the opening member 8 from the second position to the first position.

As described above, in the image forming apparatus of this configuration, the open state is stably maintained and canceled only with opening and closing operations.

In this embodiment, the holding portion 21 has three functions and serves as a guided portion to be guided by the rail portion 73 and the like, an acting portion for changing the position of the opening member 8, and an engaged portion to be engaged by the holding contact surface 711. However, the present invention is not limited to this configuration. These functional portions may be implemented by separate members or separate portions.

Also, in the present embodiment, the stay 20 is located inside the apparatus, and the frame member 7 and the opening member 8 are positioned in this order on the outer side of the stay 20. However, the present invention is not limited to this configuration. For example, the stay 20 may be sandwiched between the frame member 7 and the opening member 8, and the interaction configuration between the stay 20 and the frame member 7, the interaction configuration between the stay 20 and the opening member 8, and the interaction configuration between the frame member 7 and the opening member 8 may be configured separately.

Furthermore, the holding mechanism of the cover member 10 by the stay 20 is provided only on one side in the apparatus width direction (x-axis direction) in the present embodiment, but the same configuration may be provided on the other side.

The present embodiment is an example in which the present invention is applied to a recording apparatus as a processing apparatus that performs a predetermined process on a recording medium, a document, and the like. The housing (lower housing 2) includes the recording portion 5, which serves as the first processing portion that performs a predetermined process on a recording medium, and the convey portion (convey member 40). The cover member 10 includes the reading portion 110, which serves as the second processing portion that performs a predetermined process on a document. However, the configuration of the processing apparatus and the configuration of the processing portions are not limited to this example. For example, the present invention may be applied to a reading apparatus that reads an image from a document as a processing apparatus. In this case, the reading portion 110 may be provided in the lower housing 2 serving as the housing.

Also, the present embodiment is an example in which the present invention is applied to a liquid-discharging recording apparatus as a recording apparatus, but the present invention is also applicable to an electrophotographic image forming apparatus, an image reading apparatus, and the like. That is, the present invention is suitably applicable to an apparatus having a configuration that holds the cover member in an open state to allow access to the inside of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-173280, filed on Oct. 14, 2020, which is hereby incorporated by reference herein in its entirety.

What is claimed is:

1. A processing apparatus comprising:

a housing that accommodates a processing portion;

a cover member supported by the housing so as to be pivotable between a closed position covering an upper part of the housing and an open position opening the upper part of the housing;

a support member having a first end connected to the cover member so as to be rotatable relative to the cover member and a second end movable relative to the housing;

a guide portion provided in the housing to guide movement of the second end of the support member;

an engaging portion configured to restrict movement of the second end of the support member at the open position of the cover member; and a switching member provided in the housing and configured to be movable between a first position in which the engaging portion restricts movement of the second end of the support member and a second position in which the restriction of movement of the second end by the engaging portion is canceled.

2. The processing apparatus according to claim 1, wherein the switching member is configured to form, in the first position and together with the guide portion, a first guide passage that enables the engaging portion to restrict movement of the second end relative to the housing; and wherein the switching member is configured to form, in the second position and together with the guide portion, a second guide passage that disables the engaging portion from restricting movement of the second end relative to the housing.

3. The processing apparatus according to claim 2, wherein the support member has an action portion configured to engage with the switching member and move the switching member between the first position and the second position.

4. The processing apparatus according to claim 3, wherein the switching member is configured to engage with the action portion and move from the first position to the second position in a case where the cover member is further pivoted in an opening direction from a position in which the second end of the support member is engaged by the engaging portion.

5. The processing apparatus according to claim 4, further comprising an urging portion configured to urge the switching member to place the switching member in one of the first position and the second position.

6. The processing apparatus according to claim 5, wherein the action portion is configured to overcome an urging force of the urging portion and move the switching member from the first position to the second position in a case where the cover member is further pivoted in the opening direction from a state in which the second end of the support member is engaged by the engaging portion and the cover member is in the open position.

7. The processing apparatus according to claim 5, wherein the action portion is configured to overcome an urging force of the urging portion and move the switching member from the second position to the first position after an engaged portion in the second end of the support member is moved to a position in which the engaged portion is not engaged by the engaging portion while the switching member is in the second position and the cover member is moved from the open position to the closed position.

8. The processing apparatus according to claim 5, wherein the switching member is configured to slide between the first position and the second position along a side surface of the housing, and wherein the urging portion is provided on the side surface of the housing.

9. The processing apparatus according to claim 4, wherein the switching member includes:

a first action-receiving portion configured to, in a case where the switching member is in the first position, engage with the action portion and receive from the action portion a force that moves the switching member to the second position; and a second action-receiving portion configured to, in a case where the switching member is in the second position, engage with the action portion and receive from the action portion a force that moves the switching member to the first position.

10. The processing apparatus according to claim 4, wherein the support member includes a boss portion that serves as a guided portion to be guided by the guide portion, as the action portion, and as a engaged portion to be engaged by the engaging portion, wherein the guide portion includes a guide rail portion configured to guide the boss portion that engages with the guide rail portion in a slidable manner, wherein the engaging portion is located in a part of the guide rail portion, wherein the switching member includes a switching rail portion configured to guide the boss portion that engages with the switching rail portion in a slidable manner, and wherein the switching rail portion is configured to form the first guide passage together with the guide rail portion in a case where the switching member is in the first position, and to form the second guide passage together with the guide rail portion in a case where the switching member is in the second position.

11. The processing apparatus according to claim 10, wherein the guide rail portion and the switching rail portion are configured to be located, in a case where the switching member is in the first position, in a first relative position in which the engaging portion is exposed to a guide passage, and to be located, in a case where the switching member is in the second position, in a second relative position in which the engaging portion is not exposed to the guide passage.

12. The processing apparatus according to claim 11, wherein a protruding direction of the boss portion is substantially horizontal, wherein the switching member is configured to be movable in an up-down direction perpendicular to the protruding direction of the boss portion relative to a side surface of the housing, wherein the guide rail portion and the switching rail portion are configured to guide the boss portion in a direction perpendicular to the protruding direction of the boss portion, and wherein the guide rail portion and the switching rail portion are offset from each other in the protruding direction.

13. The processing apparatus according to claim 12, wherein, in the first relative position, the switching rail portion is displaced downward from the guide rail portion, and the engaging portion is exposed to the guide passage and extends between different levels of the guide rail portion and the switching rail portion as viewed in the protruding direction, and wherein, in the second relative position, the guide rail portion and the switching rail portion are at a same height, and the engaging portion is retracted to a position below the guide passage as viewed in the protruding direction.

14. The processing apparatus according to claim 10, wherein the boss portion is located in the second end of the support member, wherein the support member has a rotation axis that is formed by engagement between a bearing located in one of the cover member and the first end of the support member and a shaft located in the other of the cover member and the first end of the support member, and the rotation axis extends in a direction parallel to a protruding direction of the boss portion with respect to the cover member, and wherein the bearing and the shaft are engaged such that the bearing and the shaft are substantially in a fitted state in a first direction perpendicular to the rotation axis, and that the bearing and the shaft are in a non-fitted state and separated from each other by a gap in a second direction perpendicular to the rotation axis and the first direction.

15. The processing apparatus according to claim 1, wherein the processing portion includes a recording portion configured to record an image on a recording medium and a conveying portion configured to convey the recording medium.

16. The processing apparatus according to claim 1, further comprising:

a second processing portion located in the cover member, wherein the second processing portion is a reading portion configured to read an image of a document.

17. The processing apparatus according to claim 1, wherein the processing portion is a reading portion configured to read an image of a document.

* * * * *